US005083917A

United States Patent [19]

McCullough et al.

[11] Patent Number: 5,083,917

[45] Date of Patent: Jan. 28, 1992

[54] SINGLE PORT INSHOT TARGET BURNER

[75] Inventors: William S. McCullough, Carrollton; Myron C. Oglesby, Jr., Dallas; Michael E. Rose, Arlington; Raymond J. Wojcieson, Carrollton, all of Tex.

[73] Assignee: Cat Eye Co., Ltd., Osaka, Japan

[21] Appl. No.: 523,661

[22] Filed: May 15, 1990

[51] Int. Cl.[5] ..... F27B 5/14

[52] U.S. Cl. ..... 432/209; 432/222; 431/171

[58] Field of Search ..... 432/176, 222, 209, 181; 110/265; 431/159, 171, 354

[56] References Cited

U.S. PATENT DOCUMENTS

| | | | |
|---|---|---|---|
| 3,649,211 | 3/1972 | Vosper | 431/171 |
| 3,834,864 | 9/1974 | Jakobi et al. | 432/222 |
| 3,838,652 | 10/1974 | Schol | 432/222 |
| 4,203,720 | 5/1980 | Chaffee et al. | 432/222 |
| 4,306,858 | 12/1981 | Simon | 432/209 |
| 4,602,571 | 7/1986 | Chadshay | 110/265 |
| 4,701,123 | 10/1987 | Tallman et al. | 431/171 |
| 4,870,947 | 10/1989 | Kawamoto | 432/209 |
| 4,951,649 | 8/1990 | Inouchi | 432/222 |

*Primary Examiner*—Henry C. Yuen

*Attorney, Agent, or Firm*—Allegretti & Witcoff, Ltd.

[57] ABSTRACT

A furnace includes a generally cylindrical combustion chamber that is open at one end for receiving a single port inshot target burner. The combustion chamber is connected to a heat exchanger through which the combustion products are drawn by an induced draft blower. A flame retention ring is provided in the target burner to aid the flame in attaching to the outer surface of the flame retention ring and thereby improve flame lifting characteristics. Also, a frustro-conical member surrounds the end of the target burner within the combustion chamber for directing air into the combustion zone to enhance the combustion process.

7 Claims, 3 Drawing Sheets

Fig. 1
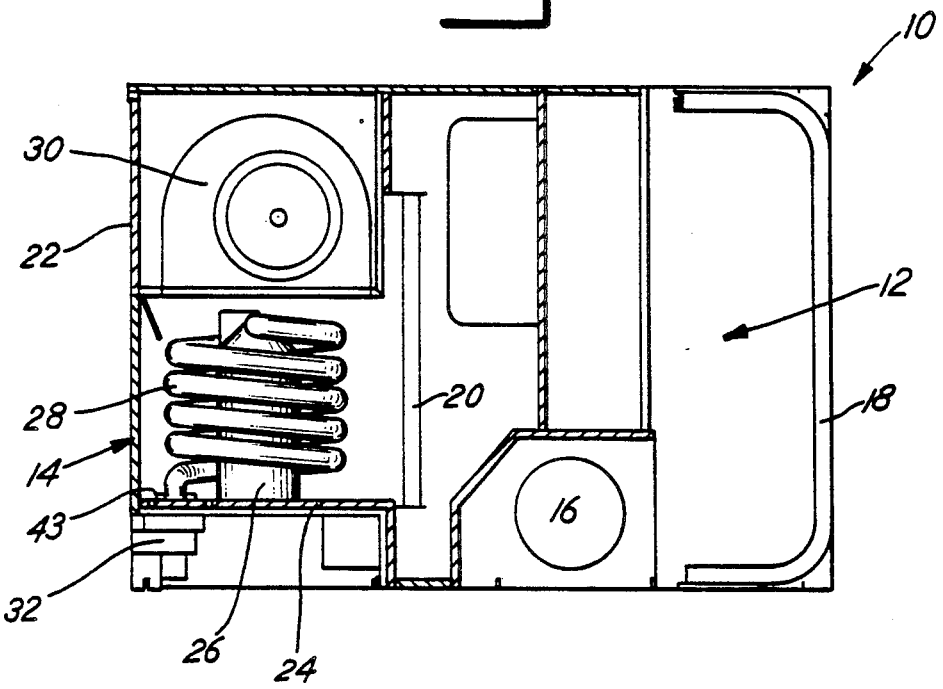
Fig. 2
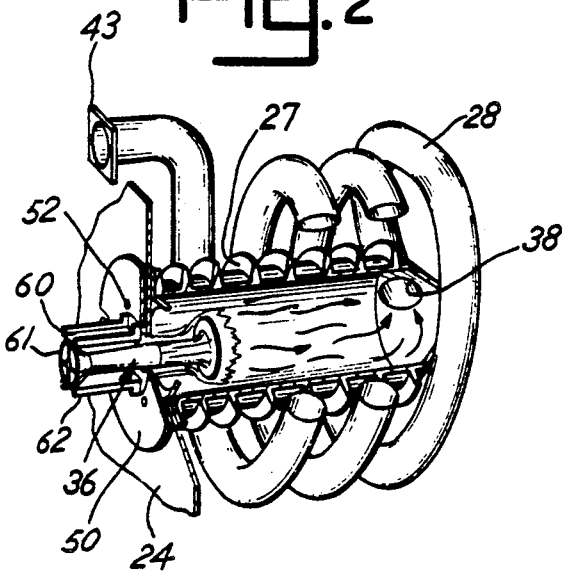
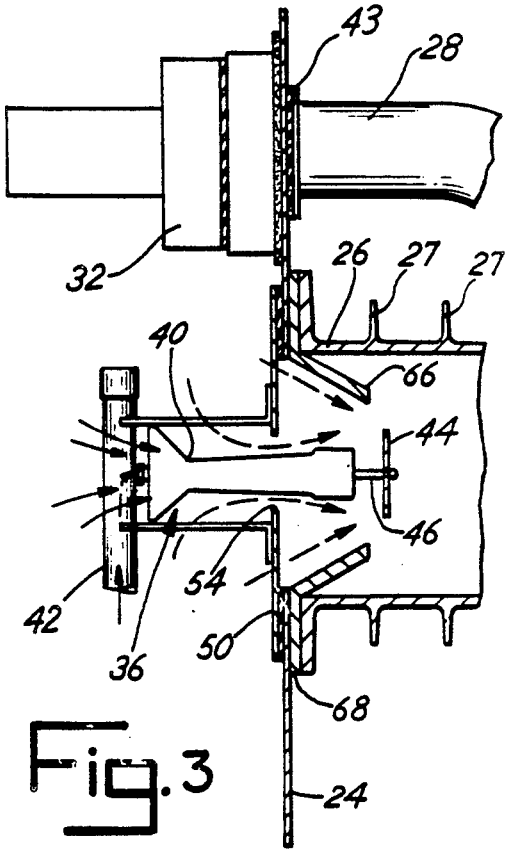
Fig. 3

Fig. 4
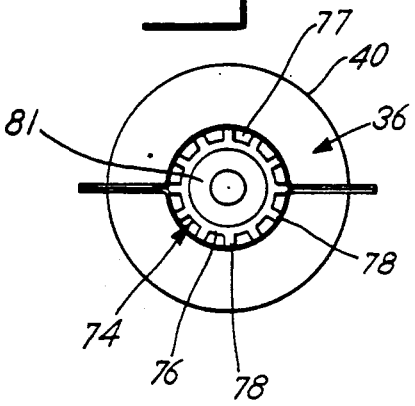
Fig. 5
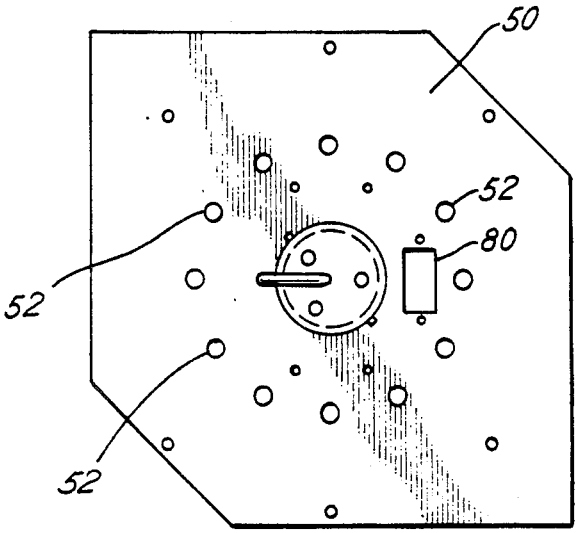
Fig. 7
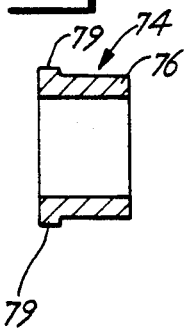
Fig. 8
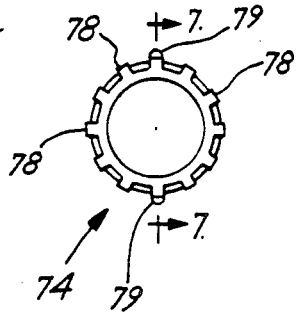
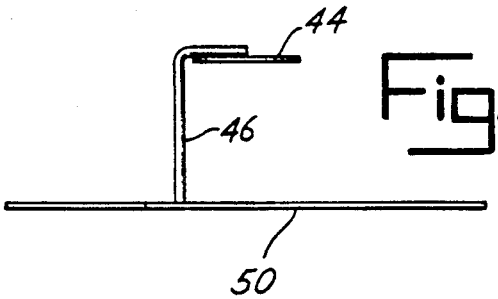
Fig. 6
Fig. 10
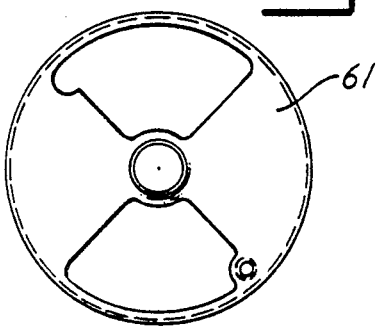
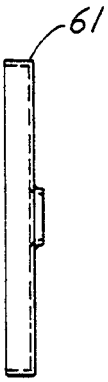
Fig. 9

SINGLE PORT INSHOT TARGET BURNER

BACKGROUND OF THE INVENTION

This invention pertains to a furnace having a generally cylindrical combustion chamber with an improved single port inshot target burner.

The problem faced was the design of a burner capable of satisfactorily firing into a compact cylindrical combustion chamber with a helical heat exchanger extending from an end thereof. Conventional target burners were tried but they did not provide sufficiently compact flames which would not overheat the combustion chamber or be quenched. If the flame were quenched, there would be incomplete combustion and possible formation of soot.

Most conventional target burner systems with high release rates are forced air systems which result in positive heat exchanger pressure. However, the inventors determined that an induced draft system was preferable because it would result in negative pressure in the heat exchanger. If there were a hole in the heat exchanger, combustion products would not leak into the conditioned indoor air. The use of an induced draft system posed stability, air/fuel ratio and mixing problems that had to be overcome.

An object of the present invention is to provide a furnace utilizing a compact generally cylindrical combustion chamber having a heat exchanger tail pipe extending therefrom with a single port inshot target burner operable with an induced air blower system that produces a negative pressure within the combustion chamber.

Another object of this invention is to provide an improved single port inshot target burner for use within a compact generally cylindrical heat exchanger having a negative pressure induced therein, said target burner having a flame retention ring in the outlet end thereof for better attaching the flame to the outer surface of the flame retention ring and thereby improve flame lifting characteristics.

Still another object of this invention is to provide an improved single port inshot target burner with a frustro-conical member encircling the target burner for directing air toward the outlet end of the target burner for enhancing the combustion process.

Other objects and advantages of the present invention will be made more apparent hereinafter.

BRIEF DESCRIPTION OF THE DRAWINGS

There is shown the attached drawing a presently preferred embodiment of the present invention wherein like numerals in the various views refer to like elements and wherein:

FIG. 1 is a schematic sectional view of a furnace with a compact generally cylindrical combustion chamber that incorporates the improved single port inshot target burner of this invention;

FIG. 2 is a perspective view of the combustion chamber and associated heat exchanger, with parts being broken away to show the single port inshot target burner;

FIG. 3 is a partial cross-sectional view of the furnace showing the arrangement of combustion chamber, single port inshot target burner, frustro-conical member, and induced air blower;

FIG. 4 is an end view of the single port inshot target burner showing the flame retention ring;

FIG. 5 is an elevation view of the backplate and target assembly which are affixed to the vestibule panel for the furnace and illustrates the holes in the back plate for secondary air;

FIG. 6 is a detail view illustrating a method of securing the target assembly on the backplate;

FIG. 7 is a cross-sectional view of the flame retention ring taken generally along the line 7—7 of FIG. 8;

FIG. 8 is an end view of the flame retention ring;

FIG. 9 is a side view of the primary air shutter of the single port inshot target burner;

FIG. 10 is a front view of the primary air shutter of the single port inshot target burner;

DETAILED DESCRIPTION OF THE PRESENT INVENTION

Figure 11:
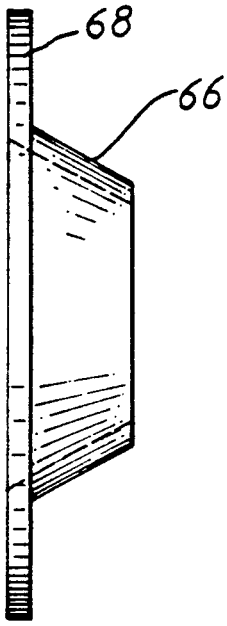
FIG. 11 is a side view of the frustro-conical member.

Referring to FIG. 1 there is shown in schematic fashion a combination heating-cooling unit 10 including an air conditioner 12 and a furnace 14. The air conditioner 12 includes a compressor 16, a condenser coil 18 and an evaporator coil 20 suitably interconnected in a refrigerant circuit. Suitable known controls are provided to operate the air conditioner.

The furnace 14 includes a housing 22 having a front wall or vestibule panel 24 which supports the compact cylindrical combustion chamber 26 and heat exchanger 28 extending from an end of the combustion chamber 26. A blower 30 is provided in the furnace 14 for moving air to be conditioned through the combination heating-cooling unit 10. During cooling, air will flow from the area to be conditioned over the evaporator and back to the conditioned area. The air conditioner 12 is operative and the furnace 14 is inoperative, hence the air will be cooled. During heating, air will be moved from the area to be conditioned over the heat exchanger 28 and back to the area to be conditioned. The air conditioner 12 is inoperative and the furnace 14 is operative, hence the air will be heated.

Secured to the vestibule panel 24 and operatively connected to the heat exchanger 28 is an induced draft blower 32 for drawing products of combustions from the heat exchanger 28 and inducing a negative pressure within the combustion chamber 26.

Turning to FIGS. 2 and 3, there is shown the single port inshot target burner 36 of the present invention disposed in operating position in the combustion chamber 26. The combustion chamber 26 is a cast iron member having external fins 27 thereon. It is open at one end and closed at the other end, but for an opening 38. The opening 38 communicates the interior of the combustion chamber 26 with the helical heat exchanger 28. Preferably, the combustion chamber 26 is made from cast iron and is compact, having a length to diameter ratio on the order of 2.3:1. The heat exchanger 28 is preferably fabricated from aluminized steel tubing which is connected at one end to the opening 38 in combustion chamber 26 and at the other end to plate 43, which is adapted to be affixed to the vestibule panel 24 in communication with the induced draft blower 32.

The single port inshot target burner 36 comprises as elongated housing 40 adapted to be connected to a fuel supply line 42 at one end and having a target plate 44 secured to an end of a rod 46 extending from the back plate 50. The fuel may be natural gas or a like heating fuel such as propane.

Affixed to the vestibule panel 24 is a back plate 50 which has a plurality of air openings 52 (FIGS. 2 and 5) and a central opening 54, which is spaced from the housing 40 of target burner 36. Brackets 60 and 62 are connected to the housing 40 and to the back plate 50 for securing the target burner 36 in position as shown in FIGS. 2 and 3.

Primary air will be drawn into housing 40 where it is mixed with gas from the supply line 42. The air-gas mixture will be ignited (as described hereinafter) and will burn at the outlet end of the housing 40 of the target burner 36. The combustion process is enhanced by secondary air supplied through openings 52 in the back plate 50 and through the space between the opening 54 in the back plate 50 and the outside of the housing 40.

A frustro-conical member 66 is positioned concentric to the axis of housing 40 for directing secondary air toward the outlet end of housing 40 and in the region between the outlet end of the housing 40 and target plate 44 to enhance the combustion process. The frustro-conical member 66 includes an annular flange 68 that is adapted to be clamped between the combustion chamber 26 and the vestibule plate 24. The member 66 is preferably fabricated from a ceramic fiber material, for example, PYROLITE. The member 66 is constructed and arranged to properly direct secondary air into the combustion zone. Also, it helps to reduce sound levels. In addition, the ceramic fiber material of member 66 has insulating qualities which allow the backplate 50 and vestibule panel 24 to operate at lower temperatures than if they were in direct contact with the combustion chamber 26.

FIG. 4 is an elevation view of the outlet end of the target burner 36. The flame retention ring 74 is positioned in the outlet end of the housing 40 of the target burner 36. The flame retention ring 74 (FIGS. 4, 7 and 8) has a tubular body 76 that is generally cylindrical and has projections 78 extending outwardly therefrom. Detents 79 (FIGS. 7 and 8) extend from two of the projections 78. The detents 79 are adapted to engage with complementary recesses in the tubular housing 40 for fixing the flame retention ring 74 in place. The tubular body is preferably made from sintered steel. A central opening 81 for passage of the fuel-air mixture extends through the body 76. The projections 78 contact the interior wall of the housing 40 and define a plurality of passages 77 for flow of the fuel-air mixture to the outlet end of the housing 40. Typically, 40% to 70% of the theoretical air needed for complete combustion flows through the target burner 36.

Preferably, the flame retention ring 74 has inner flow passage or central opening 80 and outer flow passage means defined by the passages 77 formed by the projections 78 and the interior of the target burner. The flow velocity through the outer flow passage is less than the flow velocity through the inner passage, whereby the flame is better able to attach to the outer surface of the flame retention ring 74 and thereby improve flame lifting characteristics.

Figure 13:
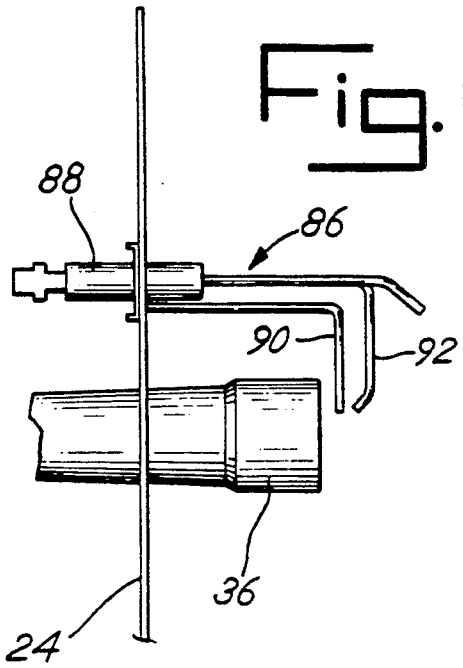
FIG. 13 illustrates the location of the ignition electrode with respect to the outlet end of the single port inshot target burner.

Turning to FIG. 5 there is better shown the back plate 50. There are a plurality of air openings 52 formed in a circular arrangement in the back plate 50 about the target burner 36. There is a rectangular opening 80 in the back plate 50 adjacent the target burner 36 for insertion and attachment of the ignition assembly 86 (FIG. 13).

There is shown in FIG. 6 the preferred manner of securing the target plate 44 in position on the back plate 50. The target plate 44 is secured to a rod 46 that is secured to the back plate 50. The rod 46 is in the form of an L, with the long arm connected to the back plate 50 and the short transverse arm connected to the target plate 44. Preferably, the rod 46 and target plate 44 are made from metal that will withstand the temperatures encountered in the combustion zone. The target plate 44 functions to improve flame retention and mixing. It is also used to shorten flame burnout, thus producing a more compact flame which will improve heat transfer to the walls of combustion chamber 26.

Referring to FIGS. 9 and 10, there is shown the air shutter 61 for controlling the flow of primary air into the housing 40. The air shutter 61, which is preferably made from a relatively rigid metal, such as aluminized steel, is rotatably fixed to the inlet end of housing 40 to control the size of the opening into the housing for regulating the flow of primary air. The air shutter 61 is used only on certain size burners.

Figure 12:
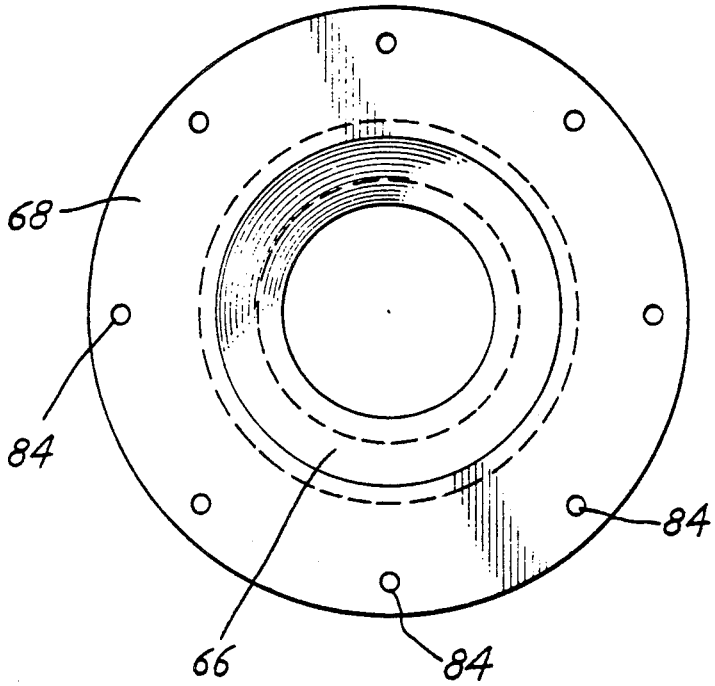
FIG. 12 is a front view of the frustro-conical member.

In FIGS. 11 and 12, there is shown the frustro-conical member 66. The flange 68 is annular and had a plurality of openings 84 therein. Mounting screws or the like for affixing the combustion chamber 26, frustro-conical member 66 and back plate 50 to the vestibule panel pass through the openings 84.

In FIG. 13, there is shown the ignition means 86 for igniting the burner flame. The ignition means 86 comprises an electrode 88 having spark ends 90, 92 located adjacent the outlet end of target burner 36 and between the outlet end and the target plate for igniting the air-fuel mixture.

The flame should be basically blue with clear yellow streaking when properly adjusted for most efficient combustion. The secondary air will be directed by the frustro-conical member 66 into the combustion zone for maximizing the combustion process. The single port inshot target burner 36 of this invention cooperates with the combustion chamber 26 to provide an efficient utilization of fuel and maximum transfer of heat from the combustion chamber 26 and the heat exchanger 28.

While we have shown and described a presently preferred embodiment of the invention, it is understood that the same is by way of illustration and example only and is not to be taken by way of limitation. The spirit and scope of the present invention are limited only by the terms of the appended claims and their proper equivalents.

I claim:

1. In a furnace, a combustion chamber having a proximal end and a remote end, an opening in said remote end, a heat exchanger communicating with said opening in said remote end, said proximal end having an opening, a single port inshot target burner extending through said proximal end opening into said combustion chamber, and an induced draft blower communicating with the heat exchanger, means for communicating fuel to said target burner, means for communicating air to said target burner for mixing with said fuel, means to ignite the air and fuel mixture, said induced draft blower being constructed and arranged to produce a negative pressure within said combustion chamber, said target burner including an elongated housing having a venturi therein, an inlet at one end and an outlet at the opposite end, a target, means for supporting said target in spaced relationship from said outlet of said target burner and a flame retention ring adjacent the outlet of said target burner, said flame retention ring comprising a body having inner flow passage means therethrough and a plurality of projections extending outwardly therefrom, said projections being constructed and arranged to engage the interior of the target burner for retaining the flame retention ring in place, there being outer flow passage means defined by the projections and the interior of the target burner, the flow velocity through the outer passage means being less than the flow velocity through the inner passage means, whereby the flame is better able to attach to the outer surface of the flame retention ring and thereby improve flame lifting characteristics.

2. A furnace as in claim 1 including a frustro-conical member surrounding the target burner for directing air toward the outlet end of the target burner.

3. A furnace as in claim 1 including a vestibule panel in the furnace, said vestibule panel having an enlarged opening therein and a plurality of smaller openings about said enlarged opening, said target burner extending through said enlarged opening into said combustion chamber, the air passing through the target burner being designated primary air and the air passing through said enlarged opening and smaller openings being designated secondary air, the primary air and fuel mixing in the target burner and the secondary air being supplied at the outlet end of the target burner for mixture with the already mixed primary air and fuel to enhance the combustion process.

4. A furnace as in claim 3 including a frustro-conical member secured to the vestibule panel and surrounding the target burner for directing secondary air toward the outlet end of the target burner.

5. A furnace as in claim 1 wherein the supporting means support the target transverse to the longitudinal axis of the elongated housing.

6. A furnace as in claim 1 wherein the supporting means comprises a rod and the target comprises a plate member secured to the rod and disposed transverse to the longitudinal axis of the elongated housing for improving flame retention.

7. A furnace as in claim 1 wherein the combustion chamber is cylindrical.

* * * * *

UNITED STATES PATENT AND TRADEMARK OFFICE

CERTIFICATE OF CORRECTION

PATENT NO. : 5,083,917

DATED : January 28, 1992

INVENTOR(S) : William S. McCullough, et al.

It is certified that error appears in the above-identified patent and that said Letters Patent is hereby corrected as shown below:

On the Title Page, Item [73], "Cat Eye Co., Ltd., Osaka, Japan" to --Lennox Industries Inc., an Iowa corporation--.

Signed and Sealed this

Nineteenth Day of April, 1994

*Attest:*

Bruce Lehman

BRUCE LEHMAN

*Attesting Officer*

*Commissioner of Patents and Trademarks*